US009188006B2

(12) United States Patent
Beeler

(10) Patent No.: US 9,188,006 B2
(45) Date of Patent: Nov. 17, 2015

(54) BOUNDARY LAYER DISK TURBINE SYSTEMS FOR CONTROLLING PNEUMATIC DEVICES

(75) Inventor: Casey L. Beeler, Lone Tree, CO (US)

(73) Assignee: Leed Fabrication Services, Inc., Brighton, CO (US)

( * ) Notice: Subject to any disclaimer, the term of this patent is extended or adjusted under 35 U.S.C. 154(b) by 402 days.

(21) Appl. No.: 13/617,313

(22) Filed: Sep. 14, 2012

(65) Prior Publication Data

US 2013/0071259 A1 Mar. 21, 2013

Related U.S. Application Data

(60) Provisional application No. 61/535,176, filed on Sep. 15, 2011.

(51) Int. Cl.

| | |
|---|---|
| ***F01D 1/36*** | (2006.01) |
| ***F04D 17/16*** | (2006.01) |
| ***F04B 35/01*** | (2006.01) |

(52) U.S. Cl.

CPC . *F01D 1/36* (2013.01); *F04B 35/01* (2013.01); *F04D 17/161* (2013.01)

(58) Field of Classification Search

CPC ..... F04D 17/161; F01D 1/36; E21B 43/40; E21B 43/16

USPC ..... 417/53, 223, 319, 313, 375, 379, 405; 166/267, 75.12

See application file for complete search history.

(56) References Cited

U.S. PATENT DOCUMENTS

| | | | | |
|---|---|---|---|---|
| 1,061,206 | A * | 5/1913 | Tesla | 415/90 |
| 2,309,075 | A * | 1/1943 | Hill | 166/266 |
| 3,007,311 | A | 11/1961 | Amero | |
| 5,819,524 | A * | 10/1998 | Bosley et al. | 60/39.465 |
| 6,174,127 | B1 | 1/2001 | Conrad et al. | |
| 6,779,964 | B2 | 8/2004 | Dial | |
| 7,695,242 | B2 | 4/2010 | Fuller | |

(Continued)

FOREIGN PATENT DOCUMENTS

| | | |
|---|---|---|
| GB | 1099479 | 1/1968 |
| WO | WO2009131477 | 10/2009 |

(Continued)

OTHER PUBLICATIONS

"Convert gas pneumatic controls to instrument air," Oct. 2006, U.S. Environmental Protection Agency.*

(Continued)

*Primary Examiner* — Charles Freay
*Assistant Examiner* — Kenneth J Hansen
(74) *Attorney, Agent, or Firm* — Lathrop & Gage LLP

(57) ABSTRACT

Provided are various devices and processes that harness the inherent kinetic energy of a flowing pressurized fluid to drive a compressor to compress a fluid without any need for electrical or chemical energy. The flowing drive fluid flows over a boundary layer disk turbine, or Tesla turbine, which is mechanically coupled to a compressor that compresses a fluid. The flowing fluid may be a natural gas from a hydrocarbon recovery operation. The compressed fluid may be air that is used to power a pneumatic device in an industrial process. Harnessing the kinetic energy of the flowing fluid increases economic efficiency of the process, while also avoiding unwanted emissions adverse to the environment and public health.

27 Claims, 4 Drawing Sheets

(56) References Cited

U.S. PATENT DOCUMENTS

| | | | | |
|---|---|---|---|---|
| 7,780,766 | B2 | 8/2010 | Thompson | |
| 7,837,768 | B2 | 11/2010 | Sanderson et al. | |
| 2001/0027652 | A1 | 10/2001 | White | |
| 2002/0064469 | A1 | 5/2002 | Palumbo | |
| 2003/0052485 | A1* | 3/2003 | Poteet et al. | 290/4 R |
| 2004/0031622 | A1 | 2/2004 | Butler et al. | |
| 2005/0169743 | A1 | 8/2005 | Hicks | |
| 2006/0254777 | A1 | 11/2006 | Wynn | |
| 2007/0116554 | A1 | 5/2007 | Brewer | |
| 2007/0274858 | A1 | 11/2007 | Childers et al. | |
| 2011/0097189 | A1 | 4/2011 | Sandoval et al. | |
| 2013/0068314 | A1 | 3/2013 | Beeler | |

FOREIGN PATENT DOCUMENTS

| | | |
|---|---|---|
| WO | WO2010/031162 | 3/2010 |
| WO | WO2011014187 | 2/2011 |
| WO | WO2013/040334 | 3/2013 |
| WO | WO2013/040338 | 3/2013 |

OTHER PUBLICATIONS

"Options for reducing methane emissions from pneumatic devices in the natural gas industry," Oct. 2006, U.S. Environmental Protection Agency.

"Natural Gas STAR Recommended Technologies and Practices—Production Sector," Mar. 2011, U.S. Environmental Protection Agency.

International Search Report and Written Opinion for PCT/US12/55388 issued Jan. 4, 2013.

International Search Report and Written Opinion for PCT/US2012/055381issued Jan. 24, 2013.

Office Action corresponding to U.S. Appl. No. 13/617,167, mailed Nov. 21, 2014.

* cited by examiner

BOUNDARY LAYER DISK TURBINE SYSTEMS FOR CONTROLLING PNEUMATIC DEVICES

CROSS-REFERENCE TO RELATED APPLICATIONS

This application claims the benefit of priority of U.S. Provisional Patent Application No. 61/535,176, filed Sep. 15, 2011, which is hereby incorporated by reference in its entirety.

BACKGROUND OF THE INVENTION

Provided herein are devices and methods for driving and controlling industrial processes using inherent kinetic energy of a fluid that is an integral part of the industrial process. In this manner, the environmental impact from the industrial process is significantly reduced and revenue to the producer increased, while maintaining and even increasing reliability and efficiency.

Conventional industrial processes may power a pneumatic device by pressurized fluid. For example, typical petroleum industry pneumatic process control devices and instruments are often powered by pressurized natural gas from a supply such as from wellhead production equipment (i.e., a petroleum separator) through a series of valves, regulators, and small vessels appropriate to the application. A concern in those systems is that significant pressurized natural gas can bleed, emit or vent, including up to all the natural gas, either constantly or when a device is actuated by the gas. In addition, loose, damaged, and worn fittings or piping in what is often a complex tube and pipe layout may also significantly contribute to fugitive emissions from the pneumatic system.

Those natural gas emissions are not only destructive to the environment and public health, but are a costly loss of potential revenue to the producer. A U.S. EPA Gas Star fact sheet states: "Pneumatic devices powered by pressurized natural gas are used widely in the natural gas industry as liquid level controllers, pressure regulators, and valve controllers. Methane emissions from pneumatic devices, which have been estimated at 51 billion cubic feet (Bcf) per year in the production sector, 14 Bcf per year in the transmission sector and <1 Bcf per year in the processing sector, are one of the largest sources of vented methane emissions from the natural gas industry." See "Options for reducing methane emissions from pneumatic devices in the natural gas industry." EPA (October 2006). See also "Convert gas pneumatic controls to instrument air." EPA (October 2006).

Although natural gas (specifically methane) emissions account for a lower overall percentage of all greenhouse gasses, the Global Warming Potential (GWP) of methane determined by EPA models is 21 times greater than $CO_2$, the most abundant greenhouse gas. The health effects of hydrocarbon emissions are also considered to be highly dangerous. Accordingly, there is a need in the art to replace hydrocarbon gas pneumatic controls to air.

Most current solutions that replace natural gas pneumatics with air pneumatics require either electric or gas-powered (natural gas or gasoline) compressors that can be very costly to purchase, operate and maintain. Furthermore, remote drilling sites may not have electric hook-up, and running gas compressors simply replace one source of pollution with another. Maintenance can become an issue for both electric and gas powered compressor systems, which is further compounded by sites that are not readily accessible. For example, all the same issues exist in a multitude of facilities including plants and offshore drilling rigs. Accordingly, the need in the art extends beyond providing air pneumatics, but includes using air pneumatics without requiring electric or gas-powered compressors to achieve sufficient air pressure to control the pneumatics. Disclosed herein are processes and systems that satisfy that need.

As discussed herein, the problem of powering a compressor without electric or gas power is solved by utilizing the kinetic energy inherent in a pressurized fluid flow in the industrial process (e.g., natural gas, petroleum, or water from the wellhead, separators, sales lines, pipelines, etc.) to drive a boundary-layer disk turbine (BLDT), which in turn mechanically drives a compressor pump. This provides a cost-effective, elegant, clean/green and robust solution to compressor power problem.

SUMMARY OF THE INVENTION

The process and devices provided herein relate to a compressor in an industrial process that does not require chemical power (e.g., from combustion of a hydrocarbon fuel) or electric power. The compressor is responsible for providing a means to control one or more parameters of the industrial process, such as controlling air and/or gas pressure, and devices related thereto. A central aspect of the process relates to harnessing the kinetic energy inherent in a pressurized fluid flow, running through optionally a closed loop fitted with appropriate regulators and valves to control pressure gradients and input power, to provide a motive force to drive a BLDT. The BLDT in turn drives a compressor pump that compresses a fluid and optionally stores the compressed fluid in an appropriately sized pressure vessel or tank.

Provided herein are various industrial processes, and systems that incorporate those industrial processes, wherein one component of the process relates to a flow of a drive fluid that is an integral part of the industrial process. Flow of the drive fluid is used to provide power or control to other components of the process. In this manner, the flowing fluid itself can significantly reduce the requirement for an external power source to control or drive the process, including to drive specific components thereof. In an aspect, the drive fluid may be the gas phase portion of a hydrocarbon recovery or storage unit, such as a vapor gas that flashes from the liquid phase. The vapor gas may be under pressure, and released to a conduit connected to a boundary layer disk turbine (BLDT), so that the pressurized vapor gas flows over the BLDT under a pressure gradient, thereby mechanically driving the BLDT. The BLDT can then be connected and employed in various configurations to advantageously drive other components depending on the specific industrial process. For example, pneumatics can be powered by connecting the BLDT to a compressor pump to compress a compressible fluid, such as air, wherein the compressed fluid is controllably used to power pneumatics as desired. Alternatively, the compressor pump may compress a hydrocarbon vapor gas to a desired pressure, such as to a desired sales or pipeline pressure. Alternatively, the BLDT can be used to both compress hydrocarbon vapor gas and to compress another fluid, such as air, to run a pneumatic device within the industrial process.

In an aspect, provided is a method of compressing a compressible fluid in an industrial process by mechanically coupling a boundary layer disk turbine (BLDT) to a compressor pump and directing a flow of a pressurized drive fluid over the BLDT to mechanically power the compressor pump. The compressor pump is mechanically powered by the BLDT and is capable of compressing a compressible fluid. Accordingly, the compressing of the compressible fluid optionally occurs without electrical or chemical power, relying instead on the kinetic energy of flowing drive fluid over the BLDT. In an aspect where it is desired to conserve energy, such as by industrial processes that are not connected to the grid, or by industrial processes where a goal is to conserve energy and/or reduce emissions, no electrical or chemical power is used to drive the compressor, and optionally no external power is required to control and/or drive the industrial process. Instead, all required power is derived from the fluid flow over the BLDT and the BLDT mechanically powering a compressor.

In another embodiment, provided is a method for powering a pneumatic device in an industrial process application by mechanically coupling a boundary layer disk turbine (BLDT) to a compressor pump and directing a flow of a pressurized drive fluid over the BLDT to mechanically power the compressor pump. A compressible fluid is compressed with the mechanically powered compressor pump, and the compressed fluid is used to power the pneumatic device. In this manner, a pneumatic device can be controlled without the need for any external energy, but instead indirectly relies on the kinetic energy of flow of pressurized fluid inherently a part of the industrial process.

In another embodiment, provided is a hydrocarbon vapor recovery method comprising mechanically coupling a boundary layer disk turbine (BLDT) to a compressor pump and directing a flow of a pressurized drive fluid over the BLDT to mechanically power the compressor pump. A flashed hydrocarbon vapor is compressed to a user-specified pressure by the mechanically powered compressor pump, thereby recovering hydrocarbon vapor, including at a desired user-selected pressure.

In an aspect, the pressurized drive fluid described in any of the methods or devices herein used to power the BLDT is from the industrial process itself. For example, the fluid can be a flashed vapor gas portion captured from a hydrocarbon recovery process, such as flashed vapor from a liquid hydrocarbon in a pressure vessel. Once adequate pressure is achieved for the vapor gas in the pressure vessel, the vapor gas is introduced to the BLDT by a controller connected to a conduit or pipe, with the flow of vapor gas driving the BLDT. The BLDT is then used to drive another component such as a compressor pump that can compress a fluid, including the flashed vapor gas that is driving the BLDT and/or air used to control a pneumatic device important for controlling one or more aspects of the industrial process. Other examples of drive fluid include water, petroleum or gas phases thereof.

In an embodiment, the boundary layer disk turbine is directly coupled to the compressor pump, such as a shaft that turns with the turbine and that directly drives compressive components of the compressor (e.g., pistons), or by a direct gear-to-gear coupling between the turbine and compressor. Alternatively, the boundary layer disk turbine is indirectly coupled to the compressor pump. "Indirect coupling" refers to one or more independent components that are connected between the BLDT and the compressor that assist in power transmission, such as a chain or belt to drive a flywheel and that can be engaged by a clutch. For example, the mechanical coupling optionally may include a pulley, a chain, and/or clutch to facilitate controlled power transmission from the BLDT to the compressor pump. In this manner, the compressor pump may be disengaged from the BLDT as desired and to provide different power transmission to the compressor pump.

In an aspect, the flow of drive fluid is provided in a closed loop. This is particularly useful wherein the drive fluid comprises a vapor gas flashed from a hydrocarbon liquid contained in a pressure vessel, and the flow is provided to a gas outlet pipeline or back to a pressure vessel for further use. In this manner, the drive fluid is not lost or vented to atmosphere, but instead is subsequently further used or captured in the industrial process after passing over the BLDT. Alternatively, the flow of drive fluid is in an open loop, wherein at least a portion of the drive fluid is released to the atmosphere. This can be useful where the drive fluid is of little economic or functional importance, such as drive fluid that is air or water.

In an aspect, the compressed compressible fluid is stored in a retention tank or other holding or separation vessel.

In an embodiment, the compressible fluid comprises air, such as room or environmental air, and the compressed air is provided to a pneumatic device, thereby powering the pneumatic device. In an aspect, "powering" refers to controlling a pneumatic device, such as a controller (liquid level, temperature), pressure regulator, pressure sensor, valve, flow sensor, flow regulator, compressor, actuator. In an aspect, the air-source is ambient air from the environment in which the industrial process and system is operating.

In an embodiment where the compressed compressible fluid is stored in a retention tank, pressure is optionally monitored in the retention tank. In this manner, the compression of the compressible fluid is controlled. For example, when the monitored pressure falls below a user-selected set-point, the BLDT and compressor are engaged to pressurize the retention tank to a value above the user-selected set-point. Similarly, compression of the compressible fluid may be controllably discontinued and the compressing step stopped when the retention tank is fully pressurized. There are many possible configurations to controllably discontinue the compression, such as by stopping the flow of drive fluid to the BLDT when the retention tank is fully pressurized by a controller, thereby stopping fluid compression in the retention tank. Alternatively, the BLDT may continue to run, but the mechanical coupling with the compressor be uncoupled or disengaged from the BLDT, such as by a clutch or switch. In an aspect, the compressor may continue to run, but instead compress fluid at a different functional location, such as to a second retention tank.

In an aspect, any of the methods and systems provided herein may utilize a compressor that operates without an electrical or hydrocarbon energy source. In other words, the compressor does not require an external source of energy, but instead is powered by an inherent part of the industrial process, namely the flow of a drive fluid over the BLDT that is mechanically coupled to the compressor. In this manner, no additional source of power (e.g., electrical or chemical fuel) is required to drive the compressor.

In an embodiment, the mechanical energy of the spinning BLDT and connection to compressor pump and other devices in the industrial process is sufficient to run and control the industrial process. Accordingly, in this embodiment no external energy source is required to control an industrial process, such as a hydrocarbon vapor recovery process.

Any BLDT known in the art may be used in any of the processes and devices provided herein. In an aspect, the BLDT comprises a stack of disks selected from a range that is greater than or equal to 2 and less than or equal to 10. In an aspect, each disk of the BLDT has a user-selected surface area range and a separation distance between adjacent disks depending on operating conditions, including operating pressures, flow-rates, viscosity and temperature. In an embodiment any one or more of disk number, separation distance, and surface area are selected to provide sufficient mechanical energy to drive a compressor pump to provide sufficient compression to drive the industrial process and/or one or more components of the industrial process.

In an embodiment, a plurality of BLDT is mechanically coupled to a plurality of compressors. In an embodiment, a plurality of BLDT is mechanically coupled to a compressor.

In an aspect, the flow of pressurized drive fluid is from a pressure vessel containing the pressurized drive fluid. In an embodiment of this aspect, once the pressure of the drive fluid in the pressure vessel is greater or equal to a user-specified value, the drive fluid is released from the pressure vessel, such as by a controller (e.g., a valve), that opens at or above a certain pressure, and the pressure in the vessel drives flow of the drive fluid from the pressure vessel to the BLDT, thereby mechanically powering the compressor connected to the BLDT.

In an embodiment, the pressure vessel is part of a hydrocarbon liquid and gas production unit, including a hydrocarbon vapor recovery unit. For example, the pressure vessel may partially contain liquid hydrocarbon(s), out of which hydrocarbon gas flashes (see, e.g., various storage tanks discussed in U.S. Pat. No. 7,780,766).

In an aspect, the drive fluid is selected from the group consisting of: a vapor gas from a hydrocarbon liquid, water, petroleum, or other natural material related to a hydrocarbon recovery or production process. In an aspect, the compressible fluid is selected from the group consisting of a vapor gas, natural gas, air. In an aspect, the compressible fluid is the same as the drive fluid, such as a hydrocarbon vapor or liquid. In an aspect, the drive fluid is different than the compressible fluid. In an aspect, the compressible fluid introduced to the compressor is a fluid that is stored in a storage tank or is a product of a separation process in a separation tank. In this fashion, any fluid at any point of an industrial process can be introduced to a compressor that is powered by the BLDT as provided herein. In this manner, the processes disclosed herein are widely applicable to a range of industrial processes where pressurization of a fluid is desired or important.

In an embodiment, the pneumatic device is selected from the group consisting of: control valves, motor valves, liquid level controls, temperature controller, pressure controller, and any combination thereof. In an aspect, the drive fluid driving the BLDT comprises natural gas and the compressible fluid comprises air. In an aspect, the compressed air provides on-demand powering of a pneumatic device. In an aspect, the compressed air is stored in a retention tank. The retention tank can store compressed air at a high pressure, thereby maintaining compression so that the air is at a suitable pressure for controlling one or more pneumatic devices in the industrial process. If the air pressure falls below a certain value, the compressor pump may be engaged to provide additional air and/or compression of air within the retention tank. Optionally, various feedback loops can be connected so that the pressure vessel containing the drive fluid is operationally connected to the retention tank, wherein pressure level in the retention tank controls introduction of flowing drive fluid to the BLDT.

In an aspect, the hydrocarbon vapor is recovered from a vapor that is flashed from a hydrocarbon liquid phase in a petroleum recovery facility or a petroleum refinery. Examples of a petroleum recovery facility include a separation facility, a natural gas plant or an offshore oil rig.

In an aspect, the flow of pressurized drive fluid comprises a hydrocarbon vapor from a hydrocarbon liquid in a pressure vessel. Examples of pressure vessels include a storage tank, a low pressure separator, and a temperature separator.

Any of the methods and systems optionally relates to a compressible fluid that is hydrocarbon vapor flashed from hydrocarbon liquid at a vapor pressure that is less a hydrocarbon sales line pressure. In this aspect, the BLDT can be used to increase the pressure of hydrocarbon vapor to a suitable pressure that matches the sales line and accordingly introduced to the sales line. In one embodiment, the hydrocarbon vapor pressure is at least 300 psi less than the hydrocarbon sales line pressure, and after suitable compression, is within at least 5%, 1% or 0.1% of sales line pressure. In an aspect, after compression the vapor pressure is equal or greater than sales line pressure. Appropriate regulators and safety valves may be employed as known in the art, such as a check-valve into the sales line to avoid unwanted back-pressure to the system.

In another aspect, the drive fluid is natural gas, petroleum, water, or any other pressurized fluid that may be part of a recovered material in the industrial process. In an aspect, the drive fluid is a gas. In an aspect, the drive fluid is a liquid.

In an embodiment, the pressurized drive fluid flows in a closed loop, and the method further comprises adjusting a first fluid flow-rate at or over the BLDT by controlling a pressure gradient in the closed loop. In an aspect of this embodiment, the method further comprises monitoring a pressure of the compressed compressible fluid and adjusting the pressure gradient in the closed loop based on the monitored compressed gas pressure. In this manner, the drive fluid flow rate over the BLDT is controlled by the pressure of the compressed compressible fluid, such as when the pressure of the compressed compressible fluid is too low, the flow-rate over the BLDT is increased, thereby increasing compression of the compressible fluid. Correspondingly, if the compressed compressible fluid pressure is sufficiently high, the drive fluid flow over the BLDT can be decreased, the compressor disconnected from the BLDT, or the compressor operably disconnected from the compressible fluid or tank holding the compressible fluid. A controller, such as pneumatic controller of flow may be employed and set to an inverse relation between pressure of the compressed fluid in the tank and flow-rate of the drive fluid. In this fashion, the lower the pressure in the tank holding the compressed fluid, the larger the work by the compressor by higher drive fluid flow rate over the BLDT.

In an embodiment, the compressed compressible fluid is introduced into a sales pipeline, wherein the compressed fluid is fed directly into the sales pipeline or stored in a retention vessel. In this manner, the fluid may be at an appropriate pressure prior to introduction to the sales line. In an aspect, the pressure of the compressed fluid is within at least 5%, 1%, 0.1% of sales line pressure, or is equal or greater than sales line pressure.

In an aspect, the method further relates to processing the stored compressed compressible fluid to purify the compressed fluid prior to introducing the compressed fluid into the sales pipeline. In an aspect, the fluid may be purified by passing the fluid through a filter, or by introducing the compressed fluid to separation tank.

In an embodiment, the method further comprises capturing the directed flow of drive fluid flow from the BLDT and outputting the captured fluid flow into a recovery outlet conduit that is connected to the BLDT. The recovery outlet pipe is optionally directed to a pressure vessel containing the drive fluid (including the original vessel from which the drive fluid is obtained), an outlet line, or a compressor.

In another embodiment, provided is a system, device or component for carrying out any of the methods described herein. The system is useful in any process wherein a pressurized drive fluid, such as liquid or gas, is available to drive a turbine, including a boundary layer disk turbine, by fluid flow and the turbine motion used to mechanically power a compressor pump that pressurizes or compresses a fluid. In this manner, the fluid pressurized by the turbine can be used in turn to power pneumatics. In an aspect, the system is used in an industrial process application such as hydrocarbon vapor recovery.

One embodiment of the present invention is directed to a self-powered compressor. "Self-powered" refers to a compressor capable of reliably running for extended periods of time without a source of electrical or chemical energy, and instead relies on fluid flow inherent in the industrial process itself to mechanically drive a compressor. In an aspect, the self-powered compressor comprises a pressure vessel containing a source of pressurized drive fluid, and a closed-loop circuit fluidically connected to a boundary layer disk turbine (BLDT) and the pressure vessel. The closed-loop circuit provides flow of the pressurized drive fluid to the BLDT under a pressure differential without loss or bleeding of the drive fluid. A compressor pump is mechanically connected to the BLDT, wherein flow of the pressurized drive fluid mechanically powers the compressor via the BLDT motion. "Pressurized fluid" refers to the fluid being at a sufficiently high pressure that it is capable of flowing over the BLDT, thereby turning the BLDT. The BLDT is, in turn, mechanically coupled directly or indirectly, to the compressor pump such that motion of the BLDT results in compressor pump compressing a compressible fluid.

In an aspect, the self-powered compressor further comprises a source of air for providing air capable of compression by the compressor pump. The source of air may be from the environment immediately surrounding the compressor. In this aspect, a pneumatic device is fluidically connected to the compressed air, wherein the pneumatic device is controlled by the compressed air.

In an embodiment, a pressure tank is operably connected to the compressor pump and fluidically connected to the pneumatic device, wherein the pump compresses air that is stored in said pressure tank. In this manner, the compressed air is used on-demand to control the pneumatic device depending on the status of a parameter within a location of the industrial process to which the compressor is connected.

In an aspect, the self-powered compressor further comprises a hydrocarbon vapor capable of compression by the compressor pump and a sales line having a sales line pressure that is fluidically connected to the compressed hydrocarbon vapor. In this aspect, the compressor compresses the hydrocarbon vapor to a vapor pressure substantially equal, equal, or equal or greater than the sales line pressure. In this aspect, "substantially equal" refers to a pressure that does not significantly affect the flow of sales gas to or through the sales gas pipeline, such as within 0.1% of the sales line pressure, or greater than or equal to the sales line pressure.

In an embodiment, the self-powered compressor further comprises a retention tank operably connected to the compressor pump, wherein the compressor pump compresses hydrocarbon vapor that is stored in the retention tank.

In an aspect, the self-powered compressor runs continuously. In an aspect, the self-powered compressor runs on-demand, wherein the compressor is automated to engage when operating conditions require compression. In this aspect, a pressure sensor may be positioned to measure pressure in the retention or holding tank of the compressed fluid, and the compressor operably engaged when the pressure sensor measures a pressure that is below a user-selected first set-point pressure and disengages when the measured pressure is above a user-selected second set-point pressure. In an embodiment, the first set-point pressure is less than the second set-point pressure. In an embodiment, the pressure difference between the two set-points is selected from a range that is greater than or equal to 5% and less than or equal to 50%.

Applications for the processes and devices provided herein are numerous and wide-ranging, and encompass the spectrum of hydrocarbon recovery operations. Any application where hydrocarbon gas exists can be recovered and compressed to line pressures using any of the devices and methods provided herein.

Without wishing to be bound by any particular theory, there can be discussion herein of beliefs or understandings of underlying principles or mechanisms relating to embodiments of the invention. It is recognized that regardless of the ultimate correctness of any explanation or hypothesis, an embodiment of the invention can nonetheless be operative and useful.

DETAILED DESCRIPTION OF THE INVENTION

Figure 1:
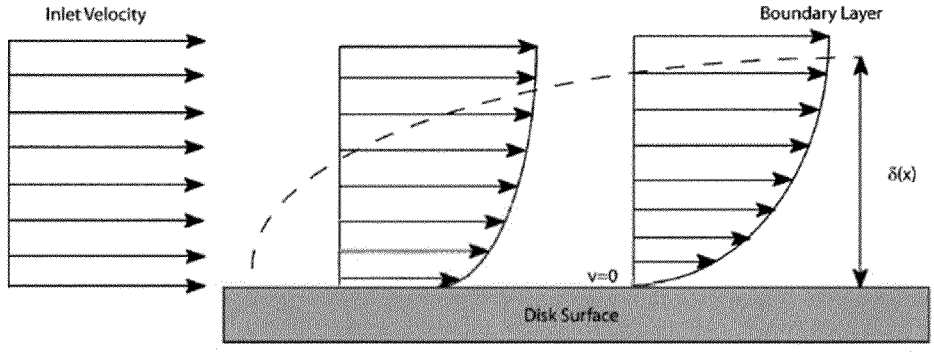
FIG. 1 illustrates the boundary layer effect that drives a BLDT.

In general, the terms and phrases used herein have their art-recognized meaning, which can be found by reference to standard texts, journal references and contexts known to those skilled in the art. The following definitions are provided to clarify their specific use in the context of the invention.

"Industrial process" refers to a procedure used in the manufacture or isolation of a material. For example, the industrial process may involve chemical or mechanical steps used in a hydrocarbon generation or recovery procedure, such as for a hydrocarbon vapor recovery unit from a hydrocarbon recovery, separation, and/or storage facility.

"Mechanically coupling" refers to a connection between two components, wherein movement of one component generates movement in another component without affecting the function of the components. The coupling can be direct, such as by a rotating shaft that is attached to two components. Alternatively, the coupling may be indirect such that there is one or more intervening components or materials between two devices, such as a belt, pulley and/or clutch.

"BLDT" or "boundary layer disk turbine", also referred to as a "Tesla turbine" (see U.S. Pat. No. 1,061,206) or a "Prandtl layer turbine" (see U.S. Pat. No. 6,174,127), refers to a stack of disks that are spaced apart and rotably mounted on a shaft. In this manner, flow of a fluid between adjacent disks generates disk rotation and corresponding rotation of shaft on which the BLDT is mounted. In this manner, fluid flow over a BLDT can generate energy in the form of a shaft rotation that can be usefully harnessed to control, or at least partially control, an industrial process.

"Pressurized drive fluid" refers to a drive fluid that is under sufficient pressure at one point compared to another point so as to generate fluid flow between the points. For example, to power a BLDT, the fluid is pressurized upstream of the BLDT compared to downstream of the BLDT, so that fluid flows over the BLDT, thereby providing mechanical rotation of the BLDT.

"Compressing" refers to increasing the pressure of a gas, such as by introducing additional gas to a fixed volume or by reducing the volume of the gas. Accordingly, compressing may be achieved by one or more of a pump and a compressor. Various compressors may be used to compress gas (referred herein as a "compressible gas"). Examples of compressors include centrifugal, axial-flow, reciprocating and rotary. Alternatively, a pump may be used to force additional gas into a fixed volume. "Compressor pump" refers to any component capable of compressing a fluid, such as a gas.

"Mechanical power" refers to a device that is powered by mechanical motion arising from flow of fluid over a BLDT. "Electrical power", in contrast, refers to a device requiring electricity to function. "Chemical power" refers to a device that is powered by a chemical process, such as by combustion. Because electrical and/or chemical power requires external input from an energy source, that power is referred to as an "external" energy source. One advantage of the processes and systems described herein is that the mechanical power can significantly reduce, or avoid altogether a need for external power, but instead leverages an inherent property of the industrial process itself, namely flow of a pressurized fluid (referred herein as a "drive fluid"). Accordingly, the mechanical power of the present invention is referred to as an "internal" energy source.

"Pneumatic device" refers to a device that is mechanically controlled by the use of a pressurized gas. Examples of pneumatic devices useful in a number of industrial processes provided herein include: pressure regulator, pressure sensor, pressure switch, pumps, valves, compressors or actuator.

"Closed loop" refers to a material, such as a fluid, that is not lost to the environment, but instead is contained within the industrial process and either fed back into the process for re-use or is captured and fed to a collector or an outlet and provided to a sales pipeline.

A compressor that is "electric free" and "gas free" refers to a compressor that is capable of solely operating by virtue of the BLDT within the industrial process. In other words, the energy required to power the compressor is internal and no external energy source is required or needed. This results in significant energy savings, including for industrial processes that may be in geographically isolated areas, or in areas where an available external energy source (e.g., the grid), is not readily accessible.

Turning to specifics of the processes and devices provided herein, one key component is the BLDT. BLDT's are known in the art and utilize boundary layer of fluids flowing over a flat plate to generate motive forces, and corresponding mechanical motion. The boundary layer effect (see FIG. 1) arises because of the viscosity or resistance of fluid to flow. Different fluids characteristically display different boundary layer thicknesses due to their viscosities. Very near the surface of the disk the velocity of the boundary layer is effectively zero. Velocity gradually increases farther out from the surface of the disk. The boundary layer thickness extends to a distance where the damping effect of this relationship between the fluid viscosity and the surface of the plate becomes negligible on the fluid itself. The viscosity and "grab" of the fluid very near the surface of the disk imparts the kinetic energy from the flowing fluid to the disk.

The grab of the fluid and the subsequent pull of each layer in the fluid on the one below causes a force to be imparted on a flat disk, as shown in FIG. 1. When two or more plates are configured in a stack, separated by a distance very near the resultant boundary layers, a significant force creates a large rotational velocity. Appropriate configuration and sizing also provides a powerful torque that when employed can be used to drive machinery, such as a compressor pump.

Figure 2:
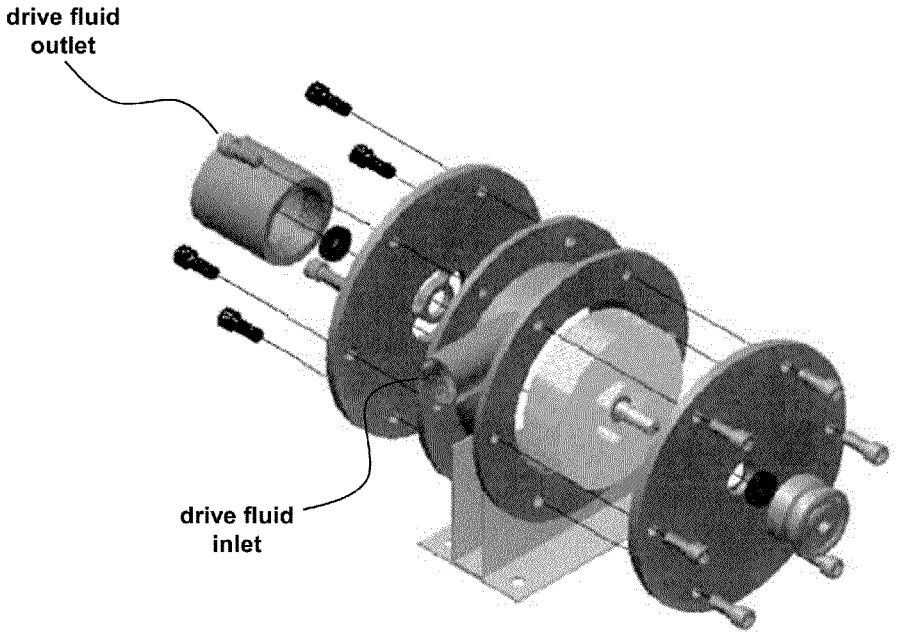
FIG. 2 is one example of a BLDT.

The stack of disks comprises a defined number of disks, $\eta$, separated by a calculated distance based on $\delta x$ shown in FIG. 1. Increasing the number and size of the disks increases the torque and power outputs. Sizing of each turbine and its associated disks is based on the specific application. The disks are separated by some form of spacer or stand-off. The disk and spacer stack is assembled onto a center shaft and corresponding disk stack (see FIG. 2). Multiple other forms or combinations of retention that keeps the disks tightly held to their respective spacing exist and can be applied herein. Those other variations, however, are not significant to the function of the BLDT.

The BLDT center shaft is held in place by the stator and can rotate by bearings inserted into appropriate placement in the end caps of the stator. The bearings are selected for the application, but typically are high speed, high torque and long life. They may be manufactured from a material known in the art, such as a ceramic. The end caps can be removable and bolted into place on the stator flange with a gasket for a seal between the stator body and the stator end cap. The bolt pattern is selected to restrict the escape of the fluid travelling through the turbine.

The disks and drive shaft themselves can be formed from any material (e.g., metals, ceramics, carbon fibers, etc.) that can withstand the very high centrifugal forces exerted on the disks due to the potentially high rotation speed. The disks are very robust and durable to withstand heat, caustic fluids and debris contained in the flowing, pressurized drive fluid. In the instance where natural gas or some other combustible fluid is used to drive the turbine, consideration to the case of catastrophic failure is included in the design. Materials that will not spark if the disks disintegrate are preferably used in the system. This is similarly a consideration when selecting the bearings and shaft for the turbine. Potential high torque and rotation speeds are also primary considerations in the BLDT design.

In the process and devices described herein, there may be several inlets to the BLDT, depending on the requirements of the turbine. An inlet flow of drive fluid enters a stator or thin cylindrical case at a location or locations tangentially and near the outer extent of its diameter. Nearly any flowing fluid can be used in the turbine to drive the disks, with disk size and separation distance selected depending on the fluid's properties. As fluid flows between the disks, whose optimal spacing is determined by boundary layer thickness, the fluid naturally increases in velocity to toward the center (centripetal) of the disk. This creates a spiral path of the fluid to the center, which helps create a very high speed and high rotational torque. As described, vent holes are manufactured near the center of the disks to allow the fluid to exit at the center of the disks near the shaft. The external side plates of the stator or turbine case holds the bearings in which the shaft rotates. A collection conduit or pipe can capture drive fluid exiting the BLDT, thereby ensuring the drive fluid is contained in a closed system or loop.

This is one embodiment of the BLDT. Efficiencies and torque ratings are very dependent on inlet and outlet configuration, as well as other design factors such as number of disks and separation of the disks. Any number of disks and appropriate spacing are used to fit the requirements of the application. In that same respect, the inlet configuration is a matter of calculated efficiencies and can be a De Laval, Venturi, converging/diverging, or adjustable configuration where the throat or inlet geometry is selected based on the application. The disk sizing and vent sizing is also a factor based on calculated efficiencies and in turn the outlet configuration and sizing. The outlets may be configured to exhaust on one side or both.

The drive side of the shaft extends outside the end cap. A centrifugal clutch or any one of several other types of clutch systems may be fastened to the external extension of the drive shaft. This allows the turbine to quickly come up to speed and torque requirements to drive the compressor pump.

The drive side in the exemplified belt-drive configuration is fitted with a centrifugal belt-pulley clutch attached to the shaft to allow the turbine to build to sufficient RPM and, therefore, enough torque to overcome the initial resistance from the compressor pump. When the RPMs meet the necessary speed, the centrifugal clutch engages driving the belt, which in turn drives the flywheel on the compressor pump. This rotation of the compressor pump flywheel and drive shaft causes the pistons or other compression means to compress fluid through an outlet to a desired location or component, depending on the application.

For example, for air pneumatics, the compressor compresses air through an outlet into a retention vessel or tank. The tank is piped to the pneumatic controls as the available power supply. When the tank is fully pressurized, a controller, such as a pressure sensor/control valve or other device can close a control valve, thereby stopping the fluid flow to the turbine, which stops the compression into the vessel or tank. For an application related to gas vapor recovery, the compressor can compress the natural gas through an outlet into a pipeline or retention vessel or tank. When all of the gas to be recovered is compressed, a motor valve or control valve (e.g., electrical or pneumatic) closes the flow of the drive gas to the turbine, thereby stopping operation of the unit until it is re-engaged based on back pressure or another signal.

Figure 3:
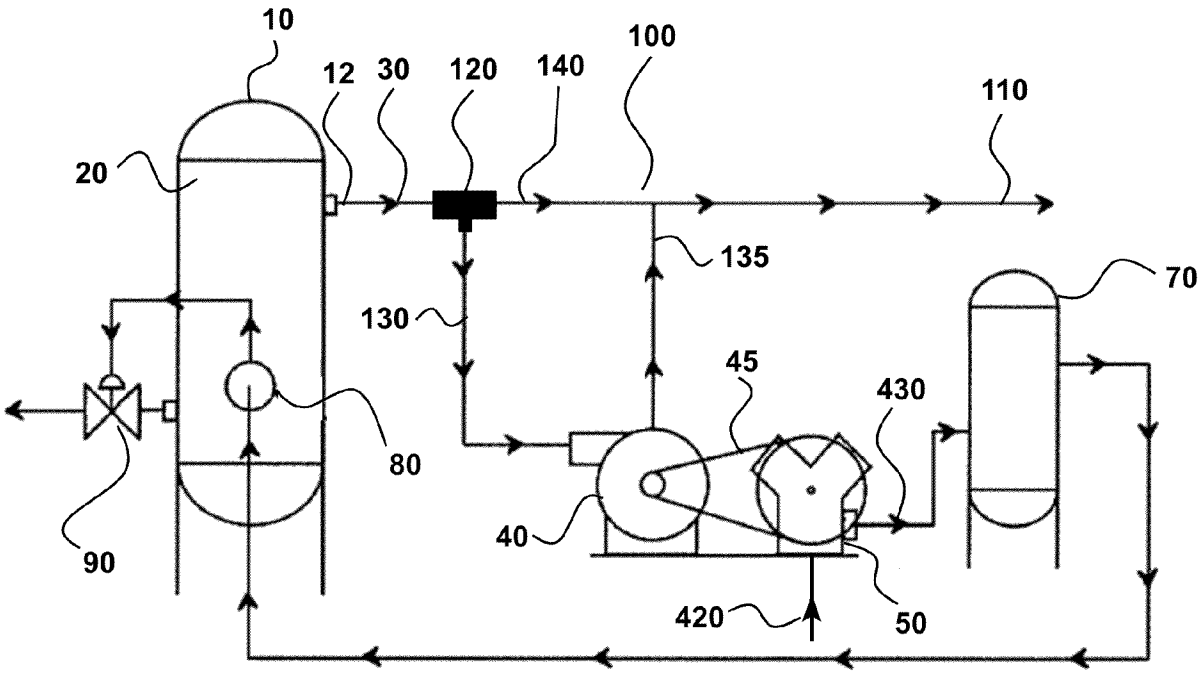
FIG. 3 is a schematic of a disk turbine pneumatic control system within an industrial process.

Although the BLDT configuration shown in FIG. 3 is a belt drive system, the coupling between the BLDT and compressor pump can just as easily be made through a direct drive, chain, or other means of coupling. In the exemplified embodiment, there is a single inlet. Alternatively, there can be multiple inlets to more quickly bring the turbine up to the required speed and torque. The drive fluid can be piped directly into the turbine, but may travel through any one or more of valves, regulators, or other rig-out, depending on the configuration for on-demand power. As described herein, several other aspects of the system, such as the required RPMs calculated to drive the compressor pump based on sizing for the application are obtained. Other generally necessary rig-out mentioned above (e.g., hammer unions or couplings, ball valves, etc.) may be in-line on either the inlet or exhaust side of the drive fluid loop or compression loop. Various means for controlling flow of either the drive fluid ("first fluid" to turbine) or recovered gas flow from the compressor pump (compressed compressible fluid) and the engagement or disengagement of the drive may be present in the system depending on the necessary pressures, RPMs, and application (e.g., pressure sensors, solenoid valves, diaphragm valves, motor valves, pressure controllers, regulators, etc.) and are employed as desired.

The invention may be further understood by the following non-limiting examples. All references cited herein are hereby incorporated by reference to the extent not inconsistent with the disclosure herewith. Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

Figure 5:
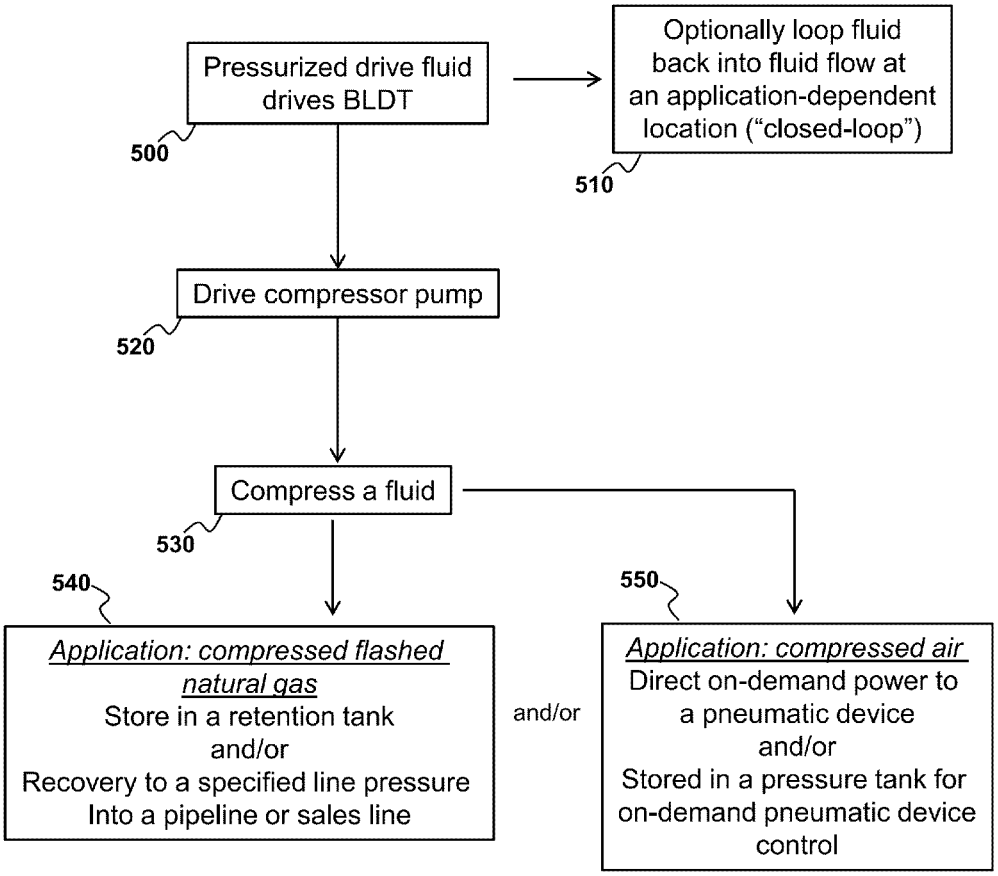
FIG. 5 is a flow-diagram of certain processes provided herein where kinetic energy in the form of fluid flow is used to control one or more aspects of an industrial process.

A generalized flow-diagram of a process is provided in FIG. 5. The inherent kinetic energy found in pressurized drive fluid flow drives a BLDT. Because of the boundary layer effect for viscous fluids flowing over a surface at specified flow rates, pressures and temperatures, the disks in the turbine rotate 500. The drive fluid may be in a closed loop 510. The BLDT drives a compressor pump that compresses a fluid 530. That fluid may be flashed natural gas for recovery (see bottom left panel 540), another fluid such as air to control a part of the industrial process, such as by a pneumatic control (bottom right panel 550), or both. Both aspects may occur simultaneously by using two BLDT, or may occur serially such as by the use of flow lines and corresponding valves and regulators to engage and disengage compression of each of the different fluids as desired.

Example 1

Disk Turbine Pneumatic Control System

FIG. 3 summarizes a method and system where the BLDT is used to provide pneumatic control. A pressure vessel 10 contains a source of pressurized drive fluid 20 and controller 12. Pressurized fluid 20 provides a flow of a pressurized drive fluid 30 over a BLDT 40 that is mechanically coupled to a compressor pump 50 by mechanical coupling 45. In this fashion, the pressurized drive fluid 30 flowing over the BLDT 40 mechanically powers compressor pump 50. Compressor pump 50 compresses a compressible fluid 420, such as air. Compressed fluid 430 is directed into a retention tank 70. The compressed fluid can be used to run controls, including a pneumatic device such as a level controller 80 and/or a dump valve 90. The dump valve regulates the amount of liquid removed from pressure vessel 10. In this example, the drive fluid may be a hydrocarbon gas such as a natural gas that is contained in a closed loop 100 and fed to an outlet flow conduit 135 or collecting line 110. The pneumatic control being powered or controlled may also be at other locations in the industrial process, such as another valve controlling the process, or other separation, retention or processing tank or pipeline. Optionally, flow regulator 12 and/or valve 120 can control pressures or flow-rates, including the relative flow-rates between BLDT inlet conduit 130 ("first" flow-rate) and bypass conduit 140 ("second" flow rate).

FIG. 5 summarizes certain steps of the process. Briefly, pressurized drive fluid drives a disk turbine (e.g., BLDT) 500 and is looped back into the fluid flow at an appropriate location in the process 510. For example, FIG. 3 illustrates the outlet flow conduit 135 from the BLDT is connected back to a line from the pressure vessel 10 or a sales line 110. Because the fluid remains in the industrial process and is not, for example, vented to atmosphere, the connection is referred to as a "closed-loop" 100. The BLDT drives a compressor pump 520 through any coupling means, direct or indirect. The compressor pump compress a compressible fluid, such as air 530, optionally into a retention tank or pressure tank for use or, alternatively, directly to power a pneumatic process control in the system 550. On demand, the compressed fluid in the retention or pressure tank or directly from the compressor pump powers a pneumatic device 550. Examples of a pneumatic device or controller include a dump valve, motor valve, level controller, temperature or pressure controller.

In an aspect, the pneumatic control by a BLDT is part of a staged-separation process. For example, referring to FIG. 5, the pressurized drive fluid 500 can be derived from a high-pressure well-head stream, or can be a from a separation tank that provides a lower drive fluid pressure, or a combination thereof. In this manner, the processes and devices provided herein can be used at any point in the hydrocarbon recovery industrial process, ranging from relatively upstream points near the well-head to more downstream processing, storage and sales points; anywhere where self-control of a pneumatic device is desired. In this aspect, a number of BLDT can be introduced throughout the industrial process, thereby providing control of pneumatic devices throughout hydrocarbon production and recovery.

Example 2

Self-Powered Compressor

One important aspect of the industrial processes provided herein is the compressor pump that is powered by fluid flow, wherein the fluid flow is an inherent part of the industrial process and external energy input is not required to generate the flow or power the compressor. This aspect is referred to as a "self-powered compressor" as no external source of energy is required to drive the compressor, but the inherent high pressure of the drive fluid is harnessed to generate mechanically-based compression. As discussed, the action of the compressor can itself be harnessed to provide useful control of various aspects of the industrial process without relying on an external energy source (see, e.g., the process flow summarized FIG. 5). This can significantly reduce the cost of the process by not only minimizing external power consumption, but by avoiding additional components, increasing reliability of the process, and reducing unwanted emissions.

Figure 4A:
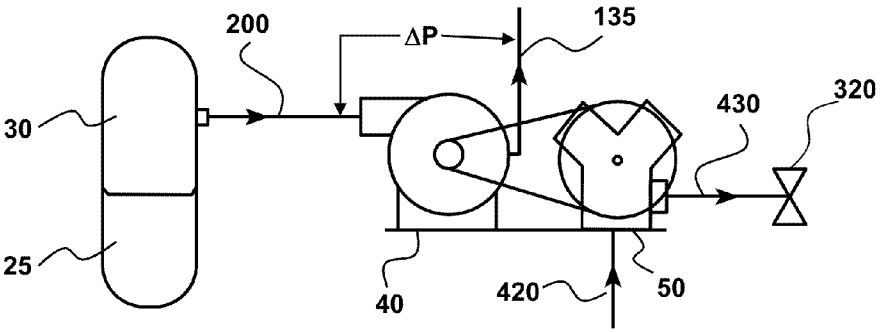
FIG. 4A is a self-powered compressor for compressing a fluid.
Figure 4B:
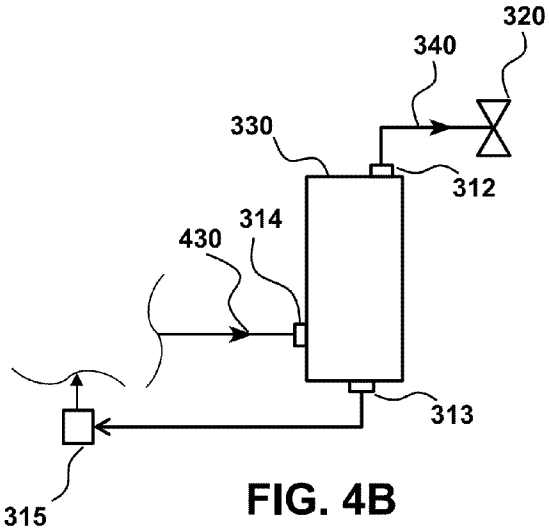
FIG. 4B shows an embodiment where the compressed fluid is stored in a retention tank or, alternatively, a fluid introduced to a compressor from a retention tank.

FIG. 4 provides an example of a self-powered compressor, similar to that employed in FIG. 3. Referring to FIG. 4A, a pressure vessel 10 contains a source of pressurized drive fluid 30, such as hydrocarbon vapor flashed from hydrocarbon liquid 25, such as from a hydrocarbon production facility (e.g., a well) or a hydrocarbon storage or holding tank. The hydrocarbon vapor may be obtained directly from the well, or may be generated from gas flashing from a liquid phase downstream in the industrial process. The pressurized fluid (also referred to as drive fluid) 30 is introduced to fluid conduit 200 that is fluidically connected to the vessel 10 and a BLDT 40 by controller 12. "Fluidically connected" refers to conduit 200 configured to provide flow of pressurized drive fluid from the vessel 10 to and over the BLDT 40 under a pressure gradient or differential, as indicated by ΔP. Mechanical motion of BLDT 40 by drive fluid 30 flowing through conduit 200 drives compressor pump 50 that is capable of compressing a compressible fluid 420, such as air from an air source. In an aspect, the air source is ambient air in the vicinity of the compressor pump 50 fluid inlet. Compressed air 430 can then be used to power a pneumatic device 320. For simplicity, FIG. 4A illustrates control of one pneumatic device. The system, however, may be used to control multiple pneumatic devices as desired such as by providing compressed air 430 to multiple pneumatic devices. FIG. 4B illustrates an embodiment where compressed air 430 is stored in a pressure tank 330. The pressure tank 330 is fluidically connected to a pneumatic device 320 by outlet conduit 340. In this manner, a large reservoir of pressurized fluid, including pressurized air, can be maintained and used on-demand by operation of controller 312 or 314. The positions of the inlet and outlet to any of the vessels disclosed herein, including tanks 10 or 70 (FIG. 3) or 330, are not important, but instead are located as desired, including along a side, top or bottom of the tank, as desired. A pressure sensor 313 can measure and monitor pressure in the tank 330 and be used to control the BLDT/compressor by a controller 315 so that compression occurs when the pressure measured by sensor 313 is below a first user-selected set-point and, similarly, compression ends when the pressure is above a second user selected set-point, such as a second set-point greater than the first set-point.

Any of the devices and processes described herein further comprise, depending on the application, components known in the art for controlling industrial processes including, valves, regulators, rig-out, sensors (pressure, temperature, flow-rate), conduits or flow lines, piping, containers, containment vessels, separators, filters, mixers. Each application includes corresponding safety devices, valves, primary and secondary pressure and flow controllers and corresponding pressure and flow rates. Each application may vary in configuration or geometry, while maintaining the overall central aspect of the invention, including aspects described as: a pressurized fluid to drive a BLDT that is looped back into the fluid flow at an appropriate location in the process.

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

All patents and publications mentioned in the specification are indicative of the levels of skill of those skilled in the art to which the invention pertains. References cited herein are incorporated by reference herein in their entirety to indicate the state of the art, in some cases as of their filing date, and it is intended that this information can be employed herein, if needed, to exclude (for example, to disclaim) specific embodiments that are in the prior art. For example, when a compound is claimed, it should be understood that compounds known in the prior art, including certain compounds disclosed in the references disclosed herein (particularly in referenced patent documents), are not intended to be included in the claim.

When a Markush group or other grouping is used herein, all individual members of the group and all combinations and subcombinations possible of the group are intended to be individually included in the disclosure. Every formulation or combination of components described or exemplified can be used to practice the invention, unless otherwise stated. Whenever a range is given in the specification, for example, a temperature range, a time range, or a pressure range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

I claim:

1. A method of compressing air in an industrial process, said method comprising the steps of:

mechanically coupling a boundary layer disk turbine (BLDT) to a compressor pump;

directing a flow of a pressurized drive fluid comprising flashed hydrocarbon vapor over said BLDT to mechanically power said compressor pump;

compressing air with said compressor pump mechanically powered by said BLDT to obtain compressed air; wherein said compressing occurs without electrical or chemical power;

storing said compressed air in a retention tank; and controlling a pneumatic device with said compressed air from said retention tank.

2. A self-powered compressor comprising:

a pressure vessel configured to contain a source of pressurized drive fluid, wherein said pressurized drive fluid is a hydrocarbon vapor flashed from a hydrocarbon-containing liquid;

a boundary layer disk turbine (BLDT);

a fluid conduit fluidically connecting said BLDT and said pressure vessel, said fluid conduit configured to provide a flow of said pressurized drive fluid to said BLDT under a pressure differential;

a compressor pump mechanically connected to said BLDT; wherein said flow of pressurized fluid over said BLDT mechanically powers said compressor;

an air source fluidically connected to said compressor pump to provide air for compression by said compressor pump;

a pressure tank fluidically connected to said compressor pump configured to hold air compressed by said compressor pump; and a pneumatic device fluidically connected to said pressure tank, wherein compressed air in said pressure tank is used to control said pneumatic device.

3. The self-powered compressor of claim 2, further comprising:

a controller for on-demand release of said compressed air in said pressure tank to control said pneumatic device.

4. The self-powered compressor of claim 2, further comprising:

a pressure sensor for measuring pressure in said pressure tank; and a controller operably connected to said pressure sensor and said compressor or said BLDT, wherein said controller is configured to engage compression when said pressure sensor measures a pressure in said pressure tank that is below a user-selected first set-point and stop compression when said measured pressure is above a user selected second set-point, wherein said user-selected first set-point is less than said user-selected second set-point.

5. A method for powering a pneumatic device in an industrial process application, said method comprising the steps of:

mechanically coupling a boundary layer disk turbine (BLDT) to a compressor pump;

directing a flow of a pressurized drive fluid over said BLDT to mechanically power said compressor pump, wherein said pressurized drive fluid comprises a flashed hydrocarbon vapor gas from a hydrocarbon-containing liquid in a pressure vessel;

compressing air with said mechanically powered compressor pump to obtain compressed air; and storing said compressed air in a retention tank, wherein said compressed air is used to power said pneumatic device.

6. The method of claim 5, wherein the boundary layer disk turbine is directly coupled to the compressor pump.

7. The method of claim 5, wherein the boundary layer disk turbine is indirectly coupled to the compressor pump.

8. The method of claim 7, wherein the mechanical coupling comprises a clutch.

9. The method of claim 5, wherein said flow of pressurized drive fluid is provided in a closed loop.

10. The method of claim 9, wherein an outlet flow of drive fluid from said BLDT is provided to a gas outlet pipeline.

11. The method of claim 5, further comprising providing said compressed air from said retention tank to said pneumatic device, thereby powering said pneumatic device.

12. The method of claim 5, further comprising:

monitoring a pressure in said retention tank, and when said monitored pressure falls below a user-selected set-point, engaging said BLDT to power said compressor to pressurize said retention tank to a value above said user-selected set-point.

13. The method of claim 12, wherein said monitoring step further comprises:

selecting a first pressure set-point and a second pressure set-point, wherein said second pressure set-point is greater than said first pressure set-point;

engaging said BLDT to power said compressor when said monitored pressure is less than first pressure set-point; and disengaging said BLDT from powering said compressor when said monitored pressure is greater than a second pressure set-point.

14. The method of claim 13, wherein said first and second pressure set-points have a pressure difference relative to each other that is greater than or equal to 5% and less than or equal to 50%.

15. The method of claim 13, wherein said step of disengaging said BLDT comprises stopping said flow of pressurized drive fluid to said BLDT.

16. The method of claim 13, wherein said step of disengaging said BLDT comprises mechanically uncoupling said BLDT from said compressor.

17. The method of claim 5, further comprising the step of stopping said compressing step when said retention tank is fully pressurized.

18. The method of claim 5, wherein said compressor operates without an external electrical or hydrocarbon combustion energy source.

19. The method of claim 5, wherein no external electrical or hydrocarbon combustion energy source is required to control the industrial process or the vapor recovery.

20. The method of claim 5, wherein a plurality of BLDT is mechanically coupled to a plurality of compressors.

21. The method of claim 5, wherein said pressure vessel is part of a hydrocarbon liquid and gas production unit.

22. The method of claim 5, wherein the pneumatic device is selected from the group consisting of: control valves, motor valves, liquid level controls, temperature controller, pressure controller, and any combination thereof.

23. The method of claim 5, wherein said pressurized drive fluid comprises natural gas and said compressible fluid comprises air.

24. The method of claim 23, wherein said compressed air from said compressing step provides on-demand powering of said pneumatic device.

25. The method of claim 5, wherein said air comprises ambient air from an environment surrounding said compressor.

26. The method of claim 5, further comprising, capturing said directed flow of drive fluid flow from said BLDT and outputting said captured fluid flow into a recovery outlet conduit.

27. The method of claim 26, wherein said recovery outlet conduit is directed to: a pressure vessel containing said drive fluid, an outlet pipeline, or a compressor.

* * * * *